United States Patent [19]

Kessell et al.

[11] 3,944,133

[45] Mar. 16, 1976

[54] AUTOMATED CENTRIFUGE

[75] Inventors: Archie Kessell, Huntington Beach, Calif.; Edward J. Kottsieper, Dresden, Maine; Charles S. Phelan, Tustin; Ralph Ranalli, Anaheim, both of Calif.

[73] Assignee: Rohe Scientific Corporation, Santa Ana, Calif.

[22] Filed: Dec. 26, 1972

[21] Appl. No.: 318,416

[52] U.S. Cl. ..... 233/26; 57/77; 57/104

[51] Int. Cl. ..... B04b 9/12

[58] Field of Search ..... 233/23 R, 24, 26, 27, 28, 233/21, 1 C, 1 B; 57/77, 104, 105, 100; 23/259

[56] References Cited

UNITED STATES PATENTS

| | | | |
|---|---|---|---|
| 581,205 | 4/1897 | Hewitt | 233/1 C |
| 1,010,016 | 11/1911 | Campau | 233/26 |
| 1,799,896 | 4/1931 | Graveline | 57/105 |
| 2,101,720 | 12/1937 | Ryan | 57/100 |
| 3,151,073 | 9/1964 | Anthon | 233/26 X |
| 3,235,173 | 2/1966 | Unger | 233/26 X |
| 3,443,373 | 5/1969 | Bryan | 57/100 X |
| 3,635,394 | 1/1972 | Natelson | 233/26 |
| 3,706,412 | 12/1972 | Latham | 233/1 B |
| 3,722,790 | 3/1973 | Natelson | 233/26 |
| 3,778,232 | 12/1973 | McMorrow | 233/26 X |

*Primary Examiner*—George H. Krizmanich
*Attorney, Agent, or Firm*—Harris, Kern, Wallen & Tinsley

[57] ABSTRACT

A centrifuge for spinning sample containers about their respective axes with such axes vertical. An inlet elevator conveys the containers in groups to the level of a spinning means which simultaneously spins the containers of each group about their respective vertical axes. The groups of centrifuged containers are conveyed downwardly by an outlet elevator on the opposite side of the spinning means from the inlet elevator. The containers of each group are suspended from a carrier having keyhole-shaped openings, the containers having necks which are receivable in the smaller ends of such openings and which are provided with external annular flanges seatable on the carrier adjacent the smaller ends of the openings to suspend the containers from the carrier. The spinning means comprises cups into which the containers are lowered by downward movement of the carrier, the latter then being moved horizontally to dispose the container necks in the larger ends of the openings in the carrier. The cups carry centrifugally responsive means movable inwardly over annular shoulders on the containers to prevent upward movement of the containers out of the cups. The spinning means is programmed by a control means which includes a cam having means for decelerating the cups in accordance with a predetermined program to avoid remixing of the centrifuged samples in the containers.

5 Claims, 8 Drawing Figures

92
86
14
76
4
4
12
18
26
28
30
64
82
88
90
78
80
70
72
74
68
84
94
96
98
100
102

AUTOMATED CENTRIFUGE

BACKGROUND OF INVENTION

The present invention relates in general to centrifuges and, more particularly, to a centrifuge for sample containers, e.g., containers in which samples of blood, urine, or the like, have been placed.

Still more particularly, the invention relates to a centrifuge of the type which spins each sample container about its axis with such axis vertical.

OBJECTS AND SUMMARY OF INVENTION

In general, a primary object of the invention is to provide an automatic centrifuge capable of procesing sample containers automatically in large volumes. A related object is to provide a centrifuge which handles the sample containers in groups and which simultaneously spins all of the sample containers in each group about their individual vertical axes.

The invention may be summarized as including, and an important object is to provide a centrifuge which comprises: spinning means for spinning the containers of a group about their respective axes with such axes vertical; an inlet elevator on one side of the spinning means for conveying the containers vertically to the level of the spinning means; an outlet elevator on the opposite side of the spinning means for conveying the containers from the level of the spinning means; and means for transferring the containers horizontally from the inlet elevator to the spinning means and from the spinning means to the outlet elevator. Related objects are to provide an inlet elevator which extends below the level of the spinning means and conveys the containers upwardly thereto, and an outlet elevator which also extends below the level of the spinning means and conveys the containers downwardly therefrom. Further related objects are to provide inlet and outlet elevators capable of handling plural groups of sample containers.

With the foregoing construction, the inlet elevator may be loaded with a plurality of groups of containers for sequential delivery to the spinning means, and the outlet elevator is capable of storing a plurality of groups of centrifuged containers pending their removal. This relationship, coupled with the fact that the sample containers are spun in groups, permits the achievement of a high processing volume.

Further, the foregoing results are achieved with a very compact centrifuge, resulting from the use of the inlet and outlet elevators on opposite sides of and extending below the spinning means. This arrangement provides a high volume centrifuge which takes up very little space.

Another important object is to provide a centrifuge wherein the spinning means comprises a plurality of upwardly facing cups rotatable about vertical axes and respectively adapted to receive the sample containers of a particular group therein.

Still another important object is to provide a carrier for a group of sample containers comprising a horizontal plate having keyhole-shaped openings the smaller ends of which are slightly larger than necks on the containers, but smaller than external annular flanges at the upper ends of the necks, the larger ends of the openings being larger than the annular flanges. With this construction, the carrier may be displaced downwardly past the annular flanges on the containers by aligning the large ends of the keyhole-shaped openings with the containers. By subsequently moving the carrier horizontally relative to the group of containers, the necks of the containers are caused to enter the smaller ends of the openings so that, upon upward displacement of the carrier, the containers are all suspended from the annular flanges at the upper ends of the necks thereof. Thus, with this construction, large groups of the containers can be handled by the inlet and outlet elevators and by the spinning means.

Another object is to provide means associated with the spinning means for lowering a carrier to insert the containers into the spinner cups, and means for then displacing the carrier horizontally so that the larger ends of the keyhole-shaped openings are in register with the necks of the containers. With this construction, the cups can be spun about their vertical axes without any possibility of having the necks of the containers contact the carrier. After spinning, the carrier is displaced horizontally to its original position, and is then moved upwardly to seat the annular flanges of the containers on the carrier, thereby removing the containers from the cups for transfer to the outlet elevator.

Yet another object of the invention is to provide centrifugally responsive means carried by the cups, and movable inwardly over annular shoulders on the containers, for preventing upward movement of the containers out of the cups under the influence of vibration.

Still another important object is to provide a control means for the spinning means which includes a cam having means for decelerating the cups in accordance with a predetermined program to avoid remixing of the sample after centrifuging.

An additional object of the invention is to provide a drive means for the cups which includes pulleys connected to the respective cups, and a belt threaded through the pulleys and engaging opposite sides of alternate pulleys. This construction facilitates maintaining driving engagement between the belt and the pulleys connected to the cups, which is an important feature.

The foregoing objects, advantages, features and results of the present invention, together with various other objects, advantages, features and results which will be evident to those skilled in the centrifuging art in the light of this disclosure, may be achieved with the exemplary embodiment of the invention illustrated in the accompanying drawings and described in detail hereinafter.

DETAILED DESCRIPTION OF EXEMPLARY EMBODIMENT OF INVENTION

Figure 1:
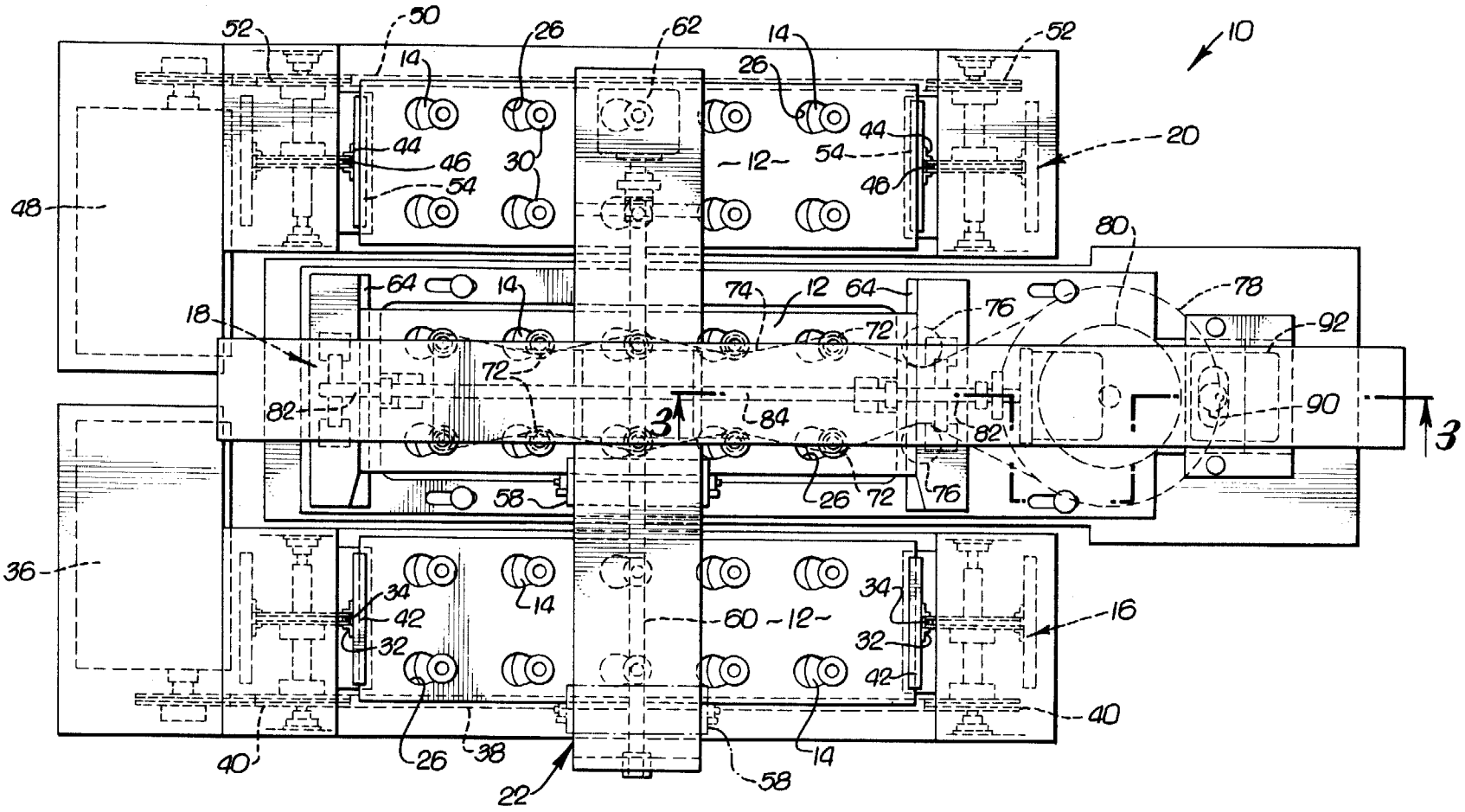
FIG. 1 is a plan view of an automatic centrifuge which embodies the invention.
Figure 2:
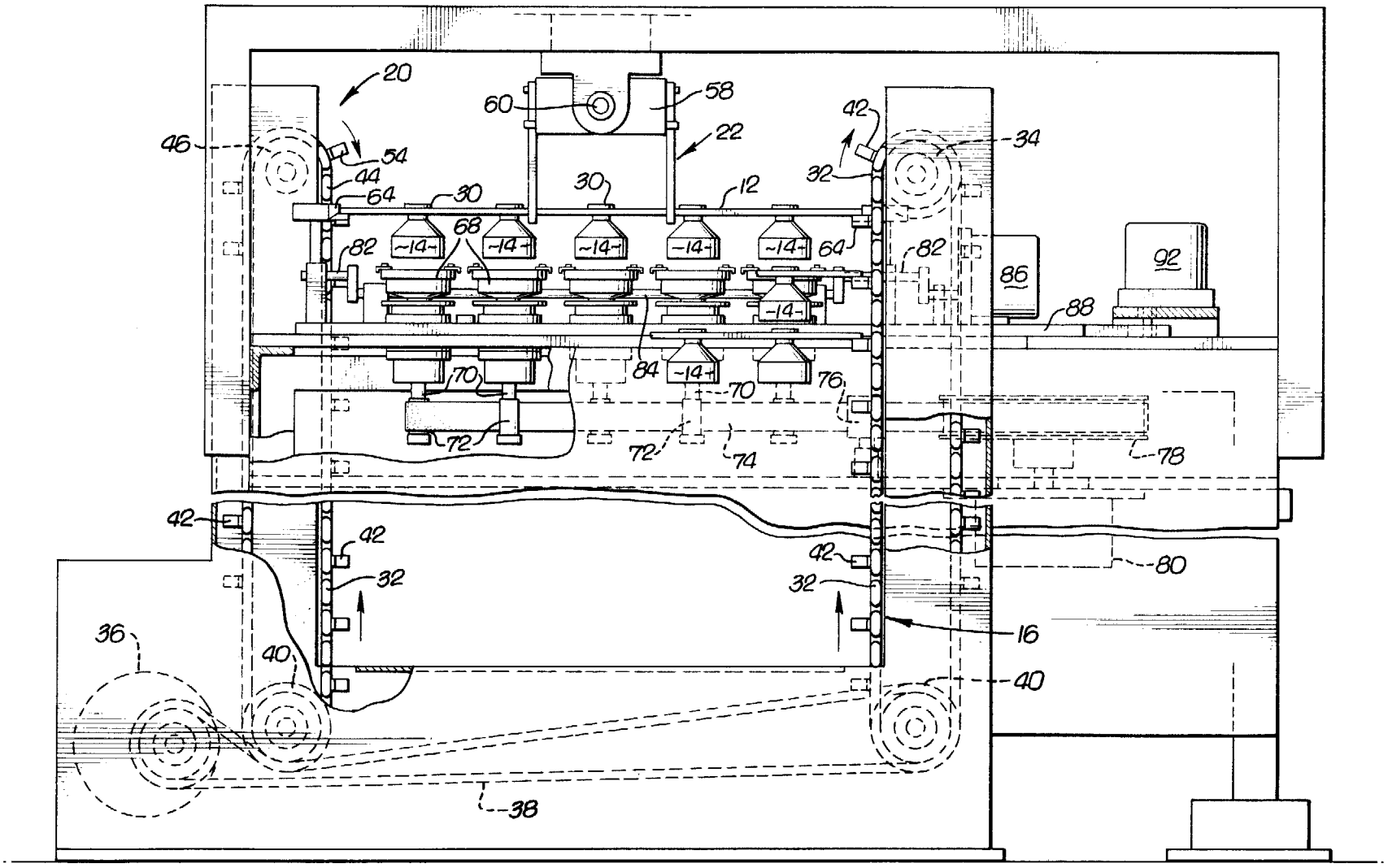
FIG. 2 is a view which is partially in elevation to show an inlet elevator of the centrifuge and which is partially in section to show, in the background, part of an outlet elevator thereof.

In the drawings, the automatic centrifuge of the invention is designated generally by the numeral 10 and includes as its major components: flat carriers or carrier plates 12 each capable of suspending therefrom a plurality or group of sample containers 14; an inlet elevator 16 for conveying carriers 12 upwardly in sequence to the level of a spinning means 18 with the axes of the containers vertical, the spinning means being adapted to spin the containers about their respective axes with such axes vertical; an outlet elevator 20 on the opposite side of the spinning means 18 from the inlet elevator 16 for conveying the carriers in sequence downwardly from the level of the spinning means, again with the axes of the containers vertical; and transferring means 22 for transferring the carriers in sequence from the inlet elevator to the spinning means and from the spinning means to the outlet elevator. The carriers 12 bearing uncentrifuged containers 14 are placed on the inlet elevator 16 manually, and the carriers bearing centrifuged containers are removed manually from the outlet elevator 20. As will become apparent, each elevator 16 and 20 is capable of supporting a plurality of carriers 12.

Figures 3, 4, 5:
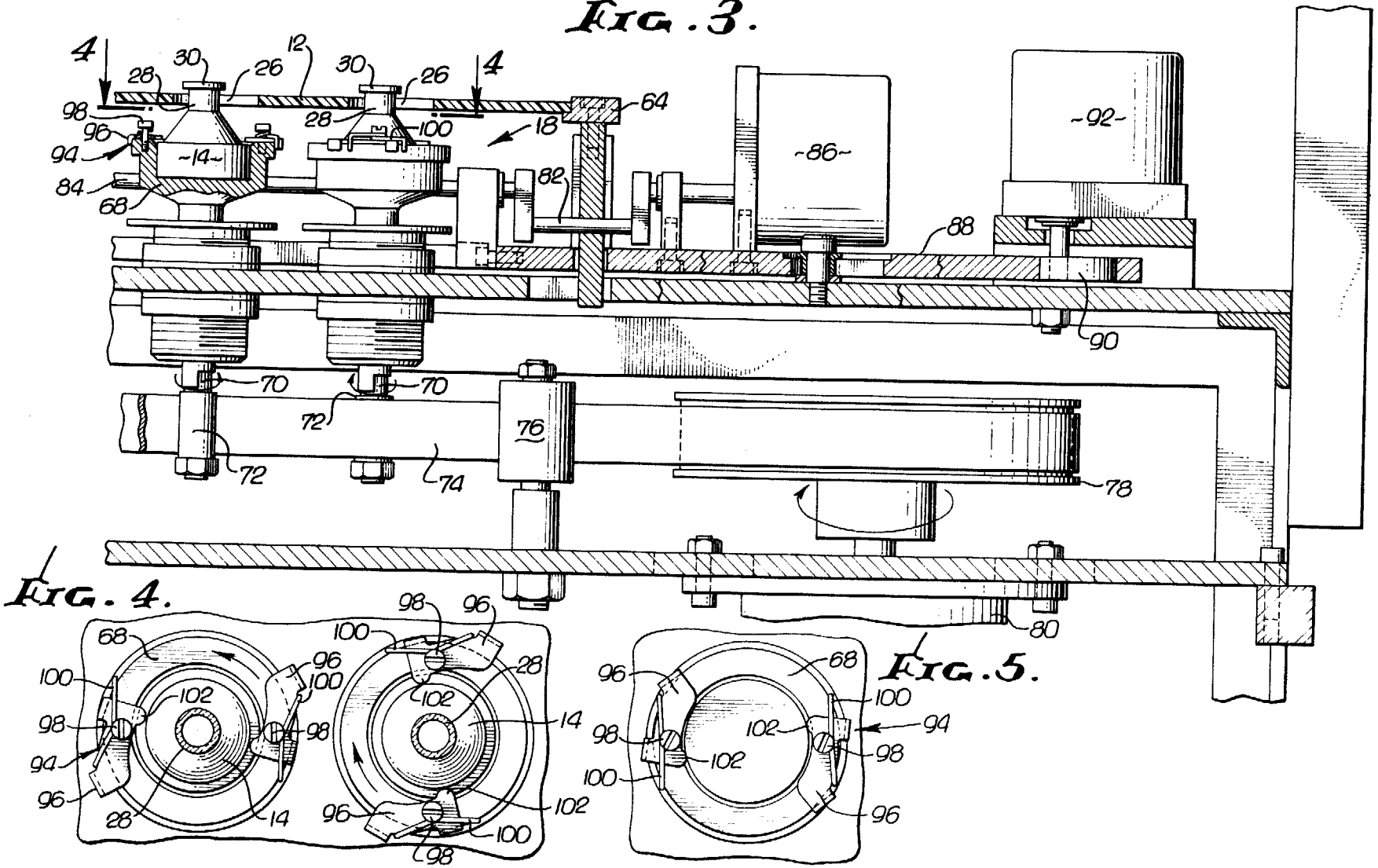
FIG. 3 is an enlarged, fragmentary sectional view taken as indicated by the arrowed line 3—3 of FIG. 1.
FIG. 4 is a fragmentary view taken as indicated by the arrowed line 4—4 of FIG. 3.
FIG. 5 is a view duplicating a portion of FIG. 4, but showing a centrifugally responsive retaining means in a retracted position.

As best shown in FIGS. 1 and 3, each carrier 12 is a flat plate provided therein with rows and columns of keyhole-shaped openings 26, there being two rows and five columns in the particular construction illustrated. The containers 14 are frustoconical flasks having cylindrical necks 28 terminating at their upper ends in external annular flanges 30. The necks 28 are slightly smaller than the smaller ends of the openings 26, while the annular flanges 30 are larger than the smaller ends of the openings, but somewhat smaller than the larger ends thereof. Thus, each carrier 12 may be loaded with containers 14 by displacing the carrier downwardly over the containers with the larger ends of the openings 26 aligned with the containers. Once the carrier 12 has been lowered below the level of the annular flanges 30, it can then be displaced horizontally to position the necks 28 in the smaller ends of the openings 26. Subsequent upward movement of the carrier 12 then seats the annular flanges 30 on the carrier to suspend the containers 14 therefrom.

The inlet elevator 16 comprises two vertical endless chains 32 spaced apart longitudinally of the centrifuge 10 on one side of the spinning means 18, these chains being trained around sprockets 34 suitably mounted on the frame of the centrifuge. The inlet elevator 16 is driven by an electric motor 36 through a chain 38 trained around sprockets 40 respectively connected to the two lower sprockets 34.

The chains 32 carry opposed lugs 42 each opposed pair of which is adapted to have the ends of one of the carriers 12 placed thereon. As will be apparent, the inlet elevator 16 is thus capable of supporting a plurality of the carriers 12 loaded with uncentrifuged containers 14.

Because the outlet elevator 20 is similar to the inlet elevator 16, it will be described at this juncture. More particularly, the outlet elevator 20 also includes two vertical endless chains 44 spaced apart longitudinally of the centrifuge 10 and located on the opposite side of the spinning means 18 from the inlet elevator 16. The chains 44 are trained around sprockets 46 and are driven by an electric motor 48, FIG. 1, through a chain 50 trained around sprockets 52 respectively connected to the lower ones of the sprockets 46. The chains 44 are provided with opposed lugs 54 each opposed pair of which is also adapted to support the ends of one of the carriers 12 with its load of centrifuged containers 14.

As will be apparent, the operator of the centrifuge 10 places carriers 12 of uncentrifuged containers 14 on the inlet elevator 16 and removes carriers of centrifuged containers from the outlet elevator 20.

In the particular construction illustrated, the transferring means 22 comprises simply a transfer member 58 movable laterally across the centrifuge 10 above the level of the spinning means 18 by a screw 60 driven by a motor 62, FIG. 1. The transfer member 58 merely pushes a carrier 12 from the inlet elevator 16 onto supports 64 which receive the ends of the carrier and which are located above the level of the spinning means. After the containers 14 with which the carrier 12 on the supports 64 is loaded have been centrifuged by the spinning means, in a manner to be described hereinafter, the transfer member 58 continues across the centrifuge 10 to displace the carrier of centrifuged containers onto the outlet elevator 20. It will be understood, of course, that the motors 36, 48 and 62 are so timed that a pair of opposed lugs 42 on the inlet elevator 16 is horizontally opposite the supports 64 in transferring a carrier 12 from the inlet elevator to the supports 64, and that a pair of opposed lugs 54 on the outlet elevator 20 is horizontally opposite the supports 64 when transferring a carrier from the supports 64 to the outlet elevator.

The spinning means 18 comprises upwardly facing cups 68 arranged in rows and columns to match the arrangement of containers 14 on each carrier 12. The cups 68 are rotatable about vertical axes by being mounted on the upper ends of vertical shafts 70 provided at their lower ends with pulleys 72. A drive belt 74 is threaded through the pulleys 72 of each row and engages opposite sides of alternate or adjacent pulleys in such row, as will be clear from FIG. 1 of the drawings. The belt is trained around the pulleys 72 at the left ends of the rows of pulleys, as viewed in FIG. 1, and then passes between two tension adjusting idler pulleys 76, the belt thereafter being trained around a pulley 78 driven by a motor 80. This motor drives the cups 68 at high rotational speeds, e.g., 20,000 revolutions per minute. Threading the belt 74 through the pulleys of each row in the manner described and shown insures positive driving contact between the belt and the pulleys.

To place the containers 14 on a particular carrier 12 in the respective cups 68, the carrier is lowered into the position shown in FIG. 3. This is accomplished by lowering the supports 64 from the raised positions they occupied when the carrier 12 was transferred thereto from the inlet elevator 16 by the transfer means 22. As shown in FIG. 3, each support 64 has connected thereto a crank 82 which moves the corresponding support 64 between its raised and lowered positions in response to 180° of crank rotation. The two cranks are interconnected by a shaft 84 and are driven by a motor 86.

The supports 64, cranks 82 and motor 86 are all mounted on a slide 88 movable longitudinally of the frame of the centrifuge 10 by an eccentric 90 driven by a motor 92 on the frame of the centrifuge. One half of a revolution of the eccentric 90 shifts the slide 88 between positions wherein the smaller and larger ends of the keyhole-shaped openings 26 are in register with the containers 14 on the particular carrier 12 at the spinning station. As shown in FIG. 3, the slide 88 has been shifted to a position such that the necks 28 of the containers 14 are in the larger ends of the openings 26, thereby providing clearances between the containers and the carrier 12 to prevent contact during centrifuging of the containers. After centrifuging, the slide 88 is shifted into a position such that the container necks 28 are in the smaller ends of the openings 26, whereupon rotation of the cranks 82 through 180° causes the carrier 12 to lift the centrifuged containers 14 out of the cups 68 for subsequent transfer to the outlet elevator 20 by the transfer member 58.

During centrifuging, the containers 14 are prevented from creeping upwardly out of the cups 68 by centrifugally responsive retaining means 94 on the cups. As best shown in FIGS. 4 and 5, the retaining means 94 associated with each cup 60 comprises two diametrically opposed weights 96 mounted on the rim of the corresponding cup by vertical pivots 98. The weights 96 are biased toward retracted positions, as shown in FIG. 5, by springs 100. However, during rotation of the cups 68, the weights 96 pivot into the positions shown in FIG. 4, in opposition to the springs 100, to dispose fingers 102 on the weights above the annular shoulder on the corresponding container 14 which results from its frustoconical configuration. These fingers 102 prevent upward migration of the containers 14 out of the cups 68 under the influence of vibration, or the like.

OPERATION OF INVENTION

Summarizing the overall operation of the centrifuge 10, the operator places carriers 12 loaded with containers 14 to be centrifuged on the inlet elevator 16. The latter operates in a step-by-step manner to position successive carriers 12 opposite the supports 64, with the latter in their raised positions. As each carrier 12 arrives at the level of the raised supports 64, the transfer member 58 displaces it laterally onto the supports 64, which are then lowered to place the containers 14 in the centrifuging cups 68. The slide 88 is then shifted to align the larger ends of the keyhole-shaped openings 26 with the container necks 28 to provide clearances, and the centrifuging motor 80 is then energized. Upon completion of the centrifuging, the slide 88 is shifted back to its initial position to dispose the container necks 28 in the smaller ends of the openings 26 in the carrier 12, whereupon the supports 64 are shifted to their raised positions to lift the centrifuged containers 14 out of the cups 68. Then, the carrier 12 of centrifuged containers 14 is shifted onto the outlet elevator 20 by the transfer member 58, such carrier subsequently being removed from the outlet elevator 20 by the operator of the centrifuge 10.

Any suitable control system for carrying out the foregoing sequence of events may be utilized to establish the necessary timed operating relationships between the various motors 36, 48, 62, 80, 86 and 92. Consequently, no overall control system has been shown.

Figure 6:
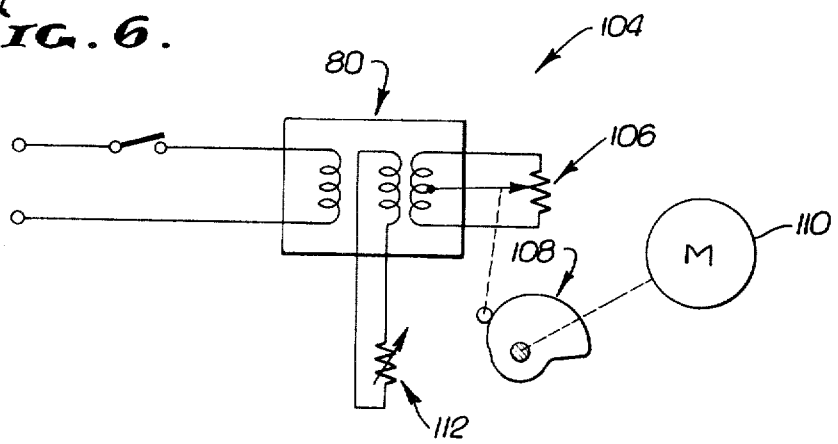
FIG. 6 is a highly simplified diagrammatic view of a control means for a spinning means of the centrifuge.
Figure 7:
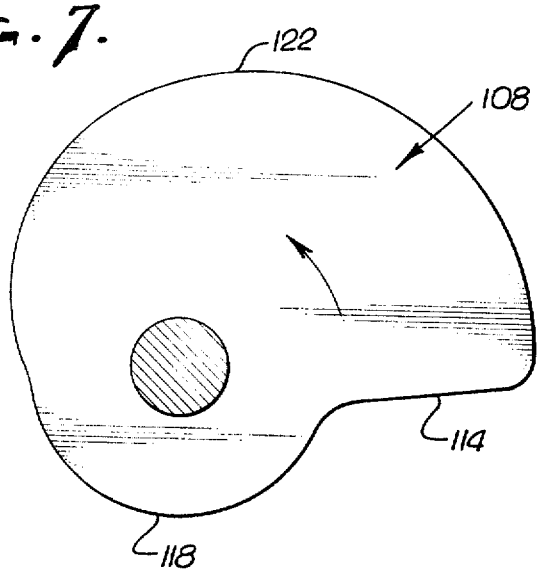
FIG. 7 is an enlarged view of an acceleration, speed and deceleration control or programming cam of the control means.

However, the invention does include a control means 104, FIG. 6, for the spinning or centrifuging motor 80 which decelerates this motor in accordance with a predetermined program designed to achieve relatively rapid deceleration without any danger of remixing of the samples in the centrifuged containers 14. More particularly, the control means 104 includes a potentiometer 106, for controlling the speed of the motor 80, which is actuated by a control cam 108 driven by a timer motor 110. The motor 80 may also be provided with a manually operable potentiometer 112 for setting the maximum motor speed.

Figure 8:
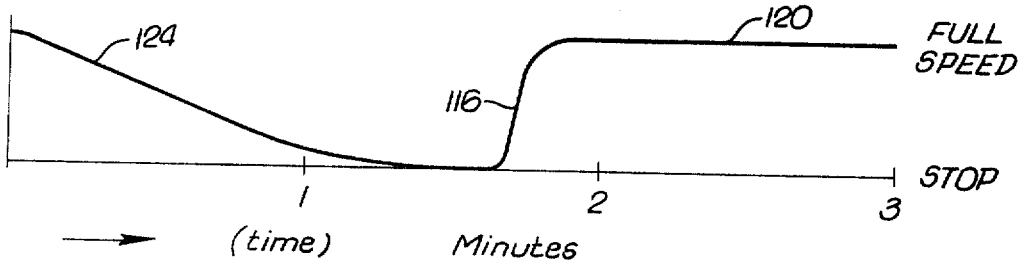
FIG. 8 is a graph showing the relationship between container rotational speed and time.

The control cam 108 is provided with a variable-radius portion 114 which causes the potentiometer 106 to accelerate the motor 80 to its operating speed, as designated by the corresponding portion 116 of the graph of FIG. 8. A constant radius portion 118 then causes the potentiometer 106 to operate the motor 80 at its predetermined maximum speed, as indicated by the portion 120 of the graph. Finally, a variable radius portion 122 of the cam 108 causes the potentiometer 106 to decelerate the motor 80 in accordance with a predetermined program, as indicated by the portion 124 of the graph of FIG. 8. The portion 122 of the control cam 108 is so shaped as to achieve deceleration in a reasonable length of time without any danger of remixing of the samples in the containers 14, which is an important feature of the invention.

Although an exemplary embodiment of the invention has been disclosed for purposes of illustration, it will be understood that various changes, modifications and substitutions may be incorporated in such embodiment without departing from the spirit of the invention as defined by the claims appearing hereinafter.

We claim as our invention:

1. In a centrifuge for sample containers, the combination of:

a. spinning means for simultaneously spinning all of the containers in a group thereof about their respective axes with such axes vertical;

b. an inlet elevator on one side of said spinning means for conveying the group of containers vertically to the level of said spinning means with the axes of the containers vertical;

c. an outlet elevator on the opposite side of said spinning means for conveying the group of containers from the level of said spinning means with the axes of the containers vertical;

d. means for transferring the group of containers horizontally from said inlet elevator to said spinning means and from said spinning means to said outlet elevator; and e. means for actuating said spinning means.

2. A centrifuge according to claim 1 wherein said inlet elevator extends below the level of said spinning means and conveys the group of containers upwardly thereto.

3. A centrifuge as set forth in claim 2 wherein said outlet elevator also extends below the level of said spinning means and conveys the group of containers downwardly therefrom.

4. In a centrifuge for sample containers having necks provided with external annular flanges at their upper ends, the combination of:

a. a horizontal carrier having keyhole-shaped openings the smaller ends of which are slightly larger than the necks of the containers but smaller than the annular flanges thereon, whereby the annular flanges may be seated on said carrier to suspend the containers when the necks are in the smaller ends of said openings;

b. spinning means comprising upwardly facing cups to receive the containers suspended from said carrier;

c. inlet conveyor means for conveying said carrier to a location above said spinning means;

d. means for moving said carrier vertically between an upper position wherein the containers suspended from said carrier are above said cups and a lower position wherein the containers are disposed in said cups;

e. means for moving said carrier horizontally, when it is in said lower position, between a position wherein the necks of the containers are in the smaller ends of said openings and a position wherein they are in the larger ends thereof;

f. means for actuating said spinning means; and g. outlet conveyor means for removing said carrier from above said spinning means.

5. A centrifuge according to claim 4 wherein said inlet and outlet conveyor means are inlet and outlet elevators disposed on opposite sides of said spinning means.

* * * * *